United States Patent [19]

Eckert

[11] Patent Number: 4,986,017

[45] Date of Patent: Jan. 22, 1991

[54] SIGN BOARD

[75] Inventor: Ronald P. Eckert, Prospect Heights, Ill.

[73] Assignee: Thomas A. Schutz Co., Inc., Morton Grove, Ill.

[21] Appl. No.: 429,046

[22] Filed: Oct. 30, 1989

[51] Int. Cl.[5] ..... G09F 7/06

[52] U.S. Cl. ..... 40/622; 40/618

[58] Field of Search ..... 40/622, 620, 618

[56] References Cited

U.S. PATENT DOCUMENTS

| | | | |
|---|---|---|---|
| 1,620,386 | 3/1927 | Osborn | 40/618 |
| 1,648,772 | 11/1927 | Lubarsky | 40/618 |
| 1,859,755 | 5/1932 | Thompson | 40/620 |
| 1,887,591 | 11/1932 | Fugita | 40/618 |
| 2,609,204 | 9/1952 | Wixon | 40/622 X |
| 2,884,723 | 5/1959 | Horton | 40/622 X |
| 4,367,604 | 1/1983 | Porter et al. | 40/564 |

FOREIGN PATENT DOCUMENTS

| | | | |
|---|---|---|---|
| 1414142 | 11/1975 | United Kingdom | 40/622 |

*Primary Examiner*—Peter A. Aschenbrenner
*Assistant Examiner*—J. Bonifanti
*Attorney, Agent, or Firm*—Wood, Phillips, Mason, Recktenwald & VanSanten

[57] ABSTRACT

A sign board having a message portion and a display portion. The message portion has horizontal, evenly spaced grooves intersected by evenly spaced, vertically oriented grooves, the horizontal and vertical grooves being perpendicular to each other. Selected letter blocks are assembled in the grooves to convey a message. Adjacent the message portion is a display portion where a scene usually associated with the message is displayed. The board is rectangular in shape and can be mounted horizontally or vertically with the appropriate set of parallel grooves being used to compose the message. Optionally, the display portion can be backlighted.

3 Claims, 1 Drawing Sheet

FIG. 1
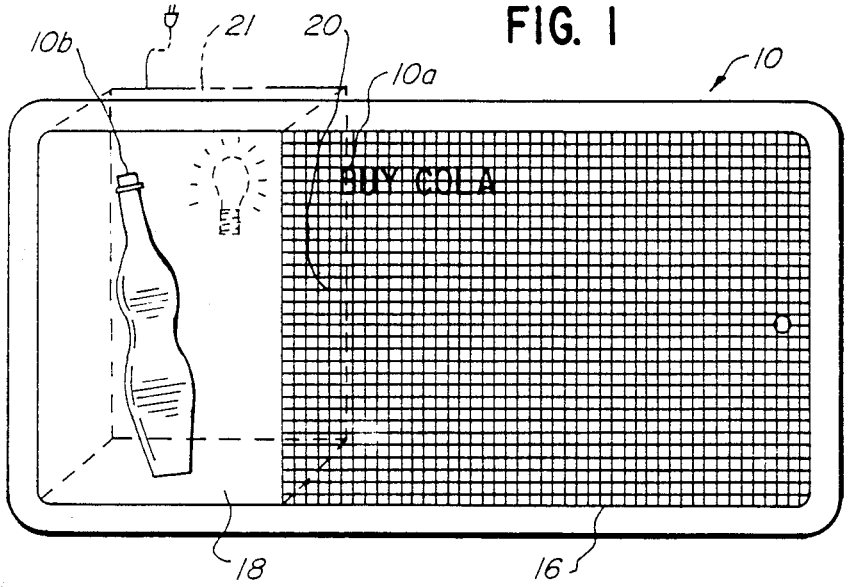
FIG. 4
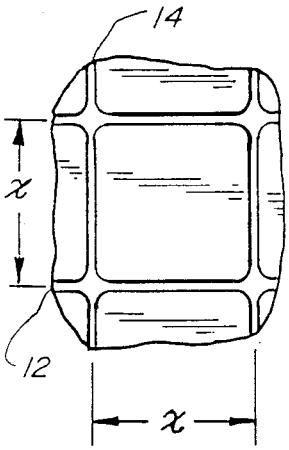
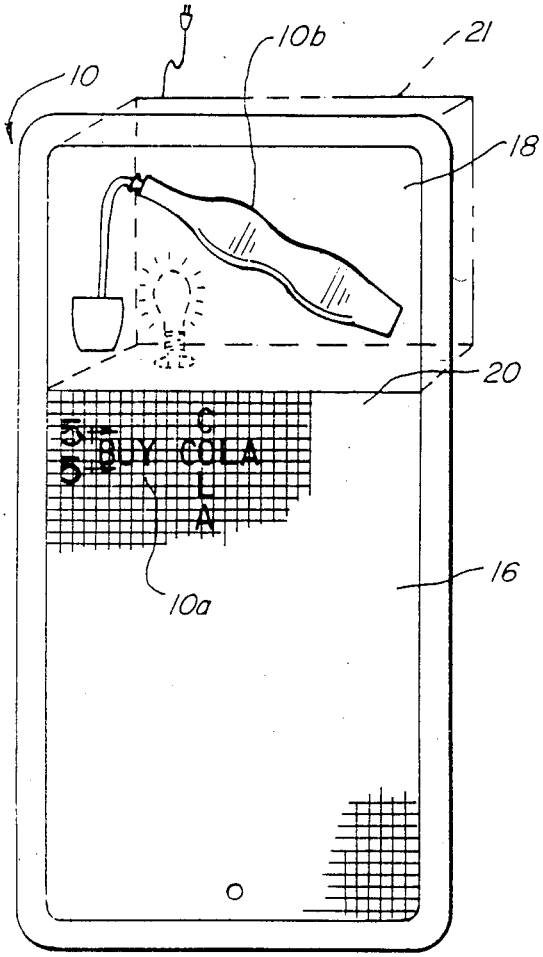
FIG. 2
FIG. 3
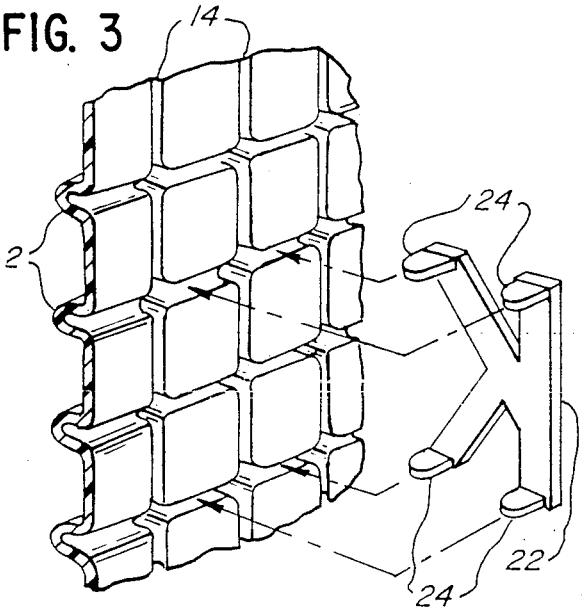
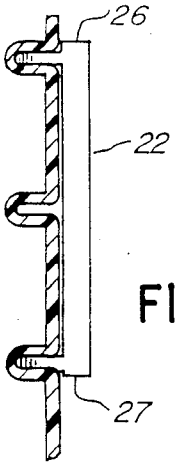
FIG. 5

SIGN BOARD

BACKGROUND OF THE INVENTION

1. Field of the Invention

This invention relates to devices used to visually present information, and, in particular, to a fixture which permits both readable messages and illustrations to be presented in a variety of relative orientations.

2. Description of the Prior Art

Media for portraying information are commonly known in many forms. One common form of such portrayal is to place a series of alpha-numeric characters on a flat surface for subsequent review by an intended reader. Typically, such a surface may comprise a board of a type adapted to the affixation of such characters. In this arrangement, it is possible to easily alter the arrangement of the alpha-numerics such that an infinity of messages may be portrayed. One method of affixing the characters to the board is to provide a series of geometric receptacles within the board which are adapted to receive rearward projecting portions of the structures which define each character. With significant limitations, examples of such boards have been disclosed in U.S. Pat. No. 61,920 and U.S. Pat. No. 1,859,755.

In addition to providing a readable message, it is often desired to include an illustration or graphic depiction within the information-portraying medium. The prior art fails to disclose a means by which both a readable message and an associated visual image may be simultaneously portrayed.

SUMMARY OF THE INVENTION

The present invention is specifically directed to constitute an improvement over the existing art in a novel and simple manner.

The invention provides a sign board where a plurality of letter blocks representing a readable message may be affixed and positioned in either a vertical or horizontal orientation, thus adapting the sign to convenient installation in a variety of environments. Additionally, a portion of the sign board is adapted to display an illustration or related image. Because of the adaptable nature of the message placement, it is convenient to orient the sign board in attitudes which correspondingly position the visual image in a variety of relations to the readable message.

The means by which the letter blocks are secured within the sign board comprise a series of perpendicular grooves in the board in which legs projecting from the individual blocks are received and pinched with sufficient force to prevent the letters from separating from the sign board in normal use.

An additional feature of the invention is the ability to slidably position the letter blocks within the sign board. Because the blocks necessarily are engaged with the board with significant retaining force, it is advantageous to be able to adjust the position of the letters by means of sliding the letter blocks rather than requiring the removal of the blocks and subsequent replacement.

A preferred embodiment of the invention includes an illumination means positioned behind the portion of the sign board which supports the illustration or visual image and thus intensifies the visibility of the image.

BRIEF DESCRIPTION OF THE DRAWINGS

FIG. 1 is an illustration of the sign board in a horizontal orientation;

FIG. 2 is an illustration of the sign board in a vertical orientation;

FIG 3 is a perspective view of a portion of the sign board, with a letter exploded therefrom;

FIG. 4 is enlarged detail view of one square on the board; and

FIG. 5 is a partial cross-sectional view taken on line 5—5 of FIG. 2.

DESCRIPTION OF THE PREFERRED EMBODIMENT

Referring to FIGS. 1–5, there is shown an illustration of the disclosed invention. A sign board 10 contains a first series of evenly spaced horizontal grooves 12 and an intersecting second series of evenly spaced vertical grooves 14 which together define a message panel 16 on the sign board 10. Also included on the sign board 10 is an integral a display panel 18 adjacently spaced from the message panel 16. The message panel 16 and display panel 18 together define a display face 20. Optionally, a light source 21 is positioned behind the display panel 18.

As shown in FIGS. 3 and 5, a letter block 22 has tabs 24 positioned along the top surface 26 and bottom surface 27 and projecting in a rearward direction therefrom. In order to affix the letters 22 to the sign board 10, the tabs 24 of the letter blocks 22 are inserted into the grooves 12 and/or 14 of the message panel 16 and pinched therebetween. In order to generate the pinching force, the tabs 24 are of a length and thickness sufficient to induce the clamping action of the grooves 12 and 14 as indicated by FIG. 3.

It should be understood that when it is desired to mount the sign board 10 in a horizontal attitude as in FIG. 1, the tabs 24 are inserted into the first series of parallel grooves 12. If it is desired to position the sign board 10 in a relation opposite to that shown in FIG. 1, the sign board 10 may be simply rotated 180 degrees and the tabs 24 of the letter blocks 22 may similarly be received by the first series of parallel grooves 12.

When it is desired to mount the sign board 10 in a vertical attitude as in FIG. 2, the tabs 24 of the letter blocks 22 are inserted into the second series of parallel grooves 14, said second series of grooves therefore being horizontal in the vertical attitude of the sign board 10 shown in FIG. 2. If it is desired to position the sign board 10 in a relation opposite to that shown in FIG. 2, the sign board 10 may be simply rotated 180 degrees and the tabs 24 of the letter blocks 22 may similarly be received by the second series of parallel grooves 14.

Due to great flexibility provided by the capability of mounting the sign board 10 in several attitudes, the sign board 10 is well adapted for use in many environments which otherwise would provide insufficient or inconvenient mounting area. Additionally, because of the closely spaced nature of both the first series 12 and second series 14 of the parallel grooves, a user has extreme flexibility in the placement of the letter blocks 22 within the message panel 16 in either horizontal or vertical orientations of the sign board 10.

An inherent feature of the invention is the capability of sliding the letter blocks 22 laterally within the parallel grooves 12 or 24 in which the tabs 24 are inserted, and yet provide sufficient retaining force to prevent the letter blocks 22 from easily separating from the sign board 10. The letter blocks 22 may be fastened to the sign board 10 in a preferred sequential relation, and may thereafter be accurately positioned within the message panel +6 by means of sliding the tabs 24 through the grooves 12 or 14. Such a feature provides significant time savings in the preparation of a message 10*a*, as well as reduces the likelihood of breaking the tabs 24 of the letter blocks 22 while alternatively removing and replacing the letter blocks 22 within the message panel 16.

In many applications, it is desirable to include an illustration or graphic depiction 10*b* in conjunction with a message 10*a* carried on the message panel 16. The illustration is suitably fastened within an integral portion of the sign board 10 which defines the display panel 18 and is positioned adjacent the grooved message panel 16. Because of the manner in which the grooves 12 and 14 are arranged, it is possible to orient the sign board 10 in such an attitude as to position the display panel 18 in various configurations relative to the message panel 16. This is a particularly useful feature in instances in which mounting space is limited in one configuration, for example, with the display panel 18 positioned above or below the message panel 16, but in which sufficient mounting space exists for positioning the sign board with the display panel 18 positioned to the right or left of the message panel 16.

Where the sign board 10 is used in a dimly lit environment, or in applications in which it is desirable to enhance the visibility of the illustration carried on the display panel 16, an electric light source 21 is attached to the sign board 10 and positioned directly behind the display panel 16. Energization of the light source 21 results in the projection of light through the plastic surface defining the display panel 16, and thereby intensifies the visibility of the illustration 10*b* contained therein and greatly enhances the visual effect achieved.

In many applications, it is desirable to include an illustration or graphic depiction 10*b* in conjunction with a message 10*a*. The illustration 10*b* is suitably fastened to the display panel 18. Through the means of a light 21 positioned behind the display panel 18, it is possible to intensify the visibility of the illustration 10*b* contained therein and greatly enhance the visual effect achieved.

I claim:

1. A sign board for a message and display fixture comprising:

a plastic board having a first series of regularly spaced parallel grooves, and a second series of regularly spaced parallel grooves, said first series of said grooves being perpendicular to said second series of grooves and intersecting therewith, whereby an area of said plastic board encompassing said first and said second series of grooves defines a message panel, said plastic board further comprising a display panel positioned adjacent said first and said second series of grooves, whereby an illustration or suitable graphic may be carried by said display panel in conjunction with said message panel, and whereby said message panel and said display panel adjacently define a display face within said plastic board; and a plurality of letter blocks to be received by said first or said second series of grooves, said blocks including means for slidable engagement with either of said first or said second series of said grooves to permit the horizontal or vertical sliding of the letter blocks within the grooves and such that disorientation of said plastic board will not disturb the position of the letter blocks contained therein.

2. A sign board as disclosed in claim 1 wherein said means for slidable securement of said letter blocks to said plastic board include a plurality of rearward projecting tabs which by means of receivable engagement with said first or said second series of spaced grooves affix said letter blocks to said plastic board in a manner which, in the absence of separating force applied directly thereto, prevents the divorce therefrom, and further allows the slidable positioning of said letter blocks within either of said first or said second series of grooves.

3. A sign board as disclosed in claim 1 wherein the grooves of said first and second series are spaced in sufficiently close relation to permit the affixation of each of said letter blocks at virtually any point selectably within said message panel.

* * * * *